US006339294B1

(12) United States Patent
Brady et al.

(10) Patent No.: US 6,339,294 B1
(45) Date of Patent: Jan. 15, 2002

(54) MAGNETRON ANODE VANES HAVING A FACE PORTION ORIENTED TOWARDS THE ANODE CENTER

(75) Inventors: Michael Barry Clive Brady, Maldon; Paul Simon Burleigh, Chelmsford, both of (GB)

(73) Assignee: EEV Limited, Essex (GB)

( * ) Notice: Subject to any disclaimer, the term of this patent is extended or adjusted under 35 U.S.C. 154(b) by 0 days.

(21) Appl. No.: 09/186,438

(22) Filed: Nov. 5, 1998

(30) Foreign Application Priority Data

Nov. 7, 1997 (GB) ..... 9723478

(51) Int. Cl.[7] ..... H01J 23/02; H01J 23/22
(52) U.S. Cl. ..... 315/39.75; 315/39.69
(58) Field of Search ..... 315/39.51, 39.65, 315/39.69, 39.71, 39.73, 39.75

(56) References Cited

U.S. PATENT DOCUMENTS

| | | | | |
|---|---|---|---|---|
| 2,530,154 A | | 11/1950 | Steele, Jr. | 315/39.69 X |
| 2,594,954 A | * | 4/1952 | Marie | 315/39.71 X |
| 4,187,444 A | * | 2/1980 | Gerard | 315/39.71 |

FOREIGN PATENT DOCUMENTS

| | | | |
|---|---|---|---|
| EP | 0 421 716 | 4/1991 | |
| EP | 0 519 803 | 12/1992 | |
| GB | 740182 | 11/1955 | |
| GB | 744713 | 2/1956 | |
| GB | 806551 | 12/1958 | |
| GB | 921 356 | 3/1963 | |
| GB | 2 054 256 | 2/1981 | |
| GB | 2 206 991 | 1/1989 | |
| JP | 62 216134 | 9/1987 | |
| JP | 050 21 014 | 1/1993 | |
| JP | 5054807 | * 3/1993 | 315/39.69 |
| JP | 080 17 354 | 1/1996 | |
| WO | WO 93/21647 | 10/1993 | |

OTHER PUBLICATIONS

K.R. Spangenberg, "Vacuum Tubes",1948, McGraw–Hill, pp.631–633.

* cited by examiner

*Primary Examiner*—Benny T. Lee
(74) *Attorney, Agent, or Firm*—Venable; Robert Kinberg; Catherine M. Voorhees

(57) ABSTRACT

An anode structure for a magnetron includes T-shape anode vanes having a radially extensive component and a circumferentially extensive portion, the cylindrical faces of the circumferential portion facing a cathode in the complete magnetron. The use of T-shape vanes increases inductance and hence permits low frequency radiation to be generated without increasing the dimensions of the magnetron compared to those of a conventional magnetron. Also, capacitance is increased to give a further reduction in frequency by using more than two anode straps, and preferably four anode straps at each end of the anode structure. Preferably, the anode structure is incorporated in a magnetron in which a high magnetic field of the order of 500 Gauss for a magnetron operating at 100 MHZ is used. The anode shell itself may form part of the magnetic return path. Other anode vane configuration, for example L-shaped, may be used.

9 Claims, 2 Drawing Sheets

MAGNETRON ANODE VANES HAVING A FACE PORTION ORIENTED TOWARDS THE ANODE CENTER

FIELD OF THE INVENTION

This invention relates to magnetrons and more particularly to anode structures for use in magnetrons.

BACKGROUND OF THE INVENTION

Magnetrons are a well known class of microwave tube and typically comprise a central cathode surrounded by a cylindrical anode structure which defines a plurality of resonant cavities. For example, the anode structure may comprise a cylindrical anode ring within which are located a plurality of radially disposed anode vanes.

Magnetrons may be used to generate microwave radiation over a range of frequencies depending on the geometry and dimensions of the anode structure. However, magnetrons are generally considered unsuitable for use in generating low frequency radiation, for example, frequencies of 400 MHZ or lower. Although these lower frequencies may be achieved by scaling up a conventional magnetron design this results in a device which occupies a large volume and is also unacceptably heavy and mechanically weak. Not only must increased amounts of materials be used to make up a larger device in any case, but also the various components must also be more massive to resist mechanical stresses imposed by a larger design and to withstand the vacuum required.

The present invention seeks to provide a magnetron, and an anode structure for use in such a magnetron which is able to operate at relatively low frequencies but is also a relatively compact and low weight structure.

According to a first aspect of the invention, there is provided an anode structure for a magnetron including a cylindrical member; and anode vanes disposed within the cylindrical member which define resonant cavities, each anode vane having a radially extensive portion, with an inner end and outer end, which adjoins the cylindrical member at its outer end and which is of substantially the same thickness at the outer end as that of the other anode vanes; and wherein each of a plurality of the anode vanes has a substantially radially extensive first portion and a second portion at its inner end which is extensive in a substantially circumferential direction.

According to a second aspect of the invention there is provided an anode structure for a magnetron, including a cylindrical member; and a plurality of anode vanes disposed within the cylindrical member which define resonant cavities, each anode vane disposed within the cylindrical member having a substantially radially extensive first portion with an inner end and an outer end and a second portion at the inner end which is extensive in a substantially circumferential direction.

According to a third aspect of the invention there in provided an anode structure for a magnetron including a cylindrical member; and anode vanes disposed within the cylindrical member which define resonant cavities, wherein each anode vane of a first set of the anode vanes has a substantially radially extensive first portion, with an inner end and an outer end, and has a second portion at its inner end which is extensive in a substantially circumferential direction; and wherein each anode vane of a second set of said anode vanes has only a substantially radially extensive portion which is of a substantially uniform thickness; and anode vanes of the first set being arranged alternately within the cylindrical member with anode vanes of the second set.

According to a fourth aspect of the invention there is provided an anode structure for a magnetron including a cylindrical member, anode vanes disposed within the cylindrical member which define resonant cavities; and wherein each anode vane of a plurality of the anode vanes has a substantially radially extensive first portion, with an inner end and an outer end, and a second portion at its inner end which is extensive in a substantially circumferential direction and at one of its ends adjoins said first portion.

In a conventional magnetron, the anode vanes include only radially extensive portions. In an anode structure in accordance with any of the aspects of the invention, the second portion of the anode vanes effectively increases the current path length around the anode cavities, thus increasing inductance in the anode structure. As the operating frequency of the magnetron is proportional to the reciprocal of the square root of inductance multiplied by capacitance, any increase in the inductance achieved by using the invention has the effect of lowering the operating frequency of the magnetron. Thus, for a given overall diameter of the anode structure and the same number of anode cavities, a significantly lower operating frequency may be achieved by employing the invention in comparison with a convectional structure.

In one advantageous embodiment of the first and second aspects of the invention for example, the first portions of at least some of the plurality join the respective second portions at the mid-point along the length of the second portion. This gives a "T-shape" anode vane. A T-shape configuration of anode vanes is advantageous because of the symmetry it offers. However, some aspects of the invention may be implemented using anode vanes which are an "L-shape" for example. Each of these may be arranged around the circumference of the cylindrical anode member in the same orientation or in another arrangement, the orientation of alternate L-shape anode vanes might be reversed, for example.

In a particularly advantageous embodiment of the first aspect of the invention for example, the plurality includes all anode vanes of the anode structure. This arrangement preserves a high degree of symmetry and a relatively large increase in inductance. However, for some applications it may be desirable, for example, to alternate a first set of anode vanes having a circumferential portion with a second set of anode vanes which are of a conventional configuration, being merely radially extensive in accordance with the third aspect of the invention.

Advantageously, more than two anode straps are included at one end of the anode structure. It is further preferred that more than two anode straps are included at each end of the anode structure. Preferably, four anode straps are included at at least one end of the anode structure. In other configurations, three, or more than four, anode straps may be included at at least one end of the anode structure.

The use of multiple anode straps in place of the usually provided two anode straps permits a large capacitance to be achieved in the anode circuit. Capacitance exists between facing surfaces of the anode straps and by employing more than two anode straps, this capacitance may thus be increased without needing to alter the dimensions or spacing of the straps from what would normally be considered suitable. Capacitance is also added between the surfaces of the anode straps and facing surfaces of the anode vane. Thus, capacitance may be increased by increasing the facing surface areas in the anode circuit without giving rise to the difficulties related to tolerance or problems with electrical breakdown which would arise if it were attempted to move the straps closer together to achieve an increase in capacitance The increase in capacitance compared to a conventional structure of the same overall dimensions gives a reduction in the magnetron operating frequency.

In one advantageous arrangement in accordance with the invention, at least one of the anode straps has a gap in its circumference located at the second portion of one of the anode vanes of the plurality. One or more gaps may be included in an anode strap without affecting its usefulness in achieving mode separation as the greater length in the circumferential direction of the vane as compared to a conventional purely radial vane permits the strap to be securely mounted in good electrical contact with the vane and also accommodate a gap. However, this leads to some reduction in capacitance and may not always be acceptable.

According to a first feature of the invention, a magnetron includes an anode structure in accordance with any aspect of the invention and a cathode is located coaxially within the anode structure.

A magnetron in accordance with the invention may be less than one thirtieth of the weight of a scaled up conventional magnetron for operation at the same frequency. As a further comparison, the reduction in diameter achievable making use of the invention leads to an anode structure of 264 mm diameter in comparison with a diameter of 1.2 m for a conventional magnetron for operation at the same frequency of 100 MHZ.

A further reduction in frequency may be achieved by providing a high magnetic field between the anode structure and the cathode. Preferably, the magnetic field strength is in the range of 500 Gauss to 2000 Gauss where the operating frequency of the magnetron is in the range of approximately 100 MHZ to 400 MHZ. As the operating frequency increases, an increase in magnetic field is required. As a comparison, for operation at 100 to 400 MHZ, in a conventional design, it would be expected to use a magnetic field of approximately 100 Gauss to 400 Gauss.

According to a second feature of the invention, a magnetron comprises means for producing a magnetic field between the anode structure and the cathode having a field strength in the range 500 Gauss to 2000 Gauss where the operating frequency of the magnetron is in the range of 100 MHZ to 400 MHZ.

In a particularly advantageous embodiment in accordance with the invention, the cylindrical member of the anode structure provides a return path for the magnetic field. In one arrangement, the cylindrical member includes steel with copper coating on its inner surface. This gives a compact structure in which it is not necessary to separately provide a magnetic return path.

BRIEF DESCRIPTION OF THE DRAWINGS

Some ways in which the invention may be performed are now described by way of example with reference to the accompanying drawings, in which.

DESCRIPTION OF PREFERRED EMBODIMENTS

Figure 1:
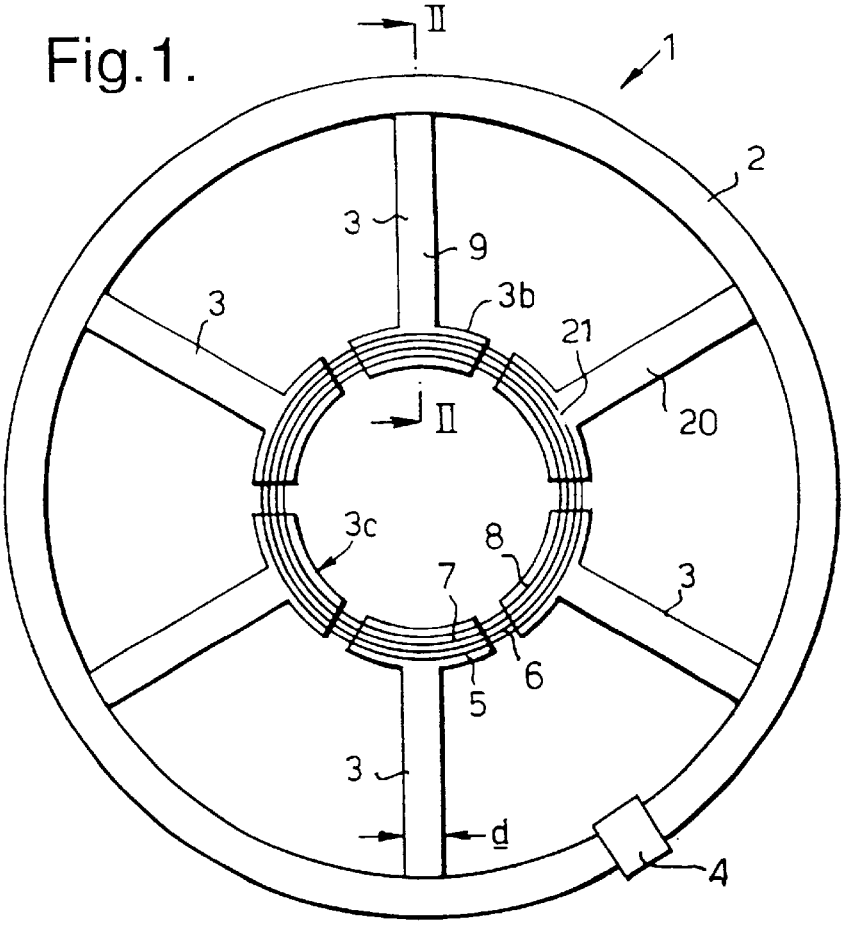
FIG. 1 schematically illustrates in plan view an anode structure in accordance with the invention.

With reference to FIG. 1, an anode structure 1 comprises a cylindrical anode shell member also referred to as a "cylindrical member" or an "anode ring"; which in this embodiment is of steel and has its interior surface coated with a thin copper layer. In other embodiments the cylindrical member 2 may be wholly of copper as in conventional magnetrons. Six anode vanes 3 are located within the cylindrical member 2. Each vane 3 has a radially extensive portion 3*a* and a circumferentially extensive portion 3*b* at its inner end. Each anode vane 3 is thus substantially T-shaped in transverse section and presents a part-cylindrical surface 3*c* facing inwardly towards the region where the cathode is located in a complete magnetron. The radially extensive portions are of the same thickness d where they adjoin the cylindrical member 2. The T-shape vanes 3 present a higher inductance than would be the case with a conventional anode structure geometry in which each vane consists only of a radial component. The path for currents flowing around each anode cavity is increased as it also includes the "arms" of the T-shaped vanes that is, the circumferentially extensive portions 3*b*. Each anode vane may be a composite of two separate radial and circumferential parts which are joined or may be a single integral component The anode structure 1 also includes a part 4 via which energy may be extracted during operation of the complete magnetron using conventional coupling mechanisms.

Figure 2:
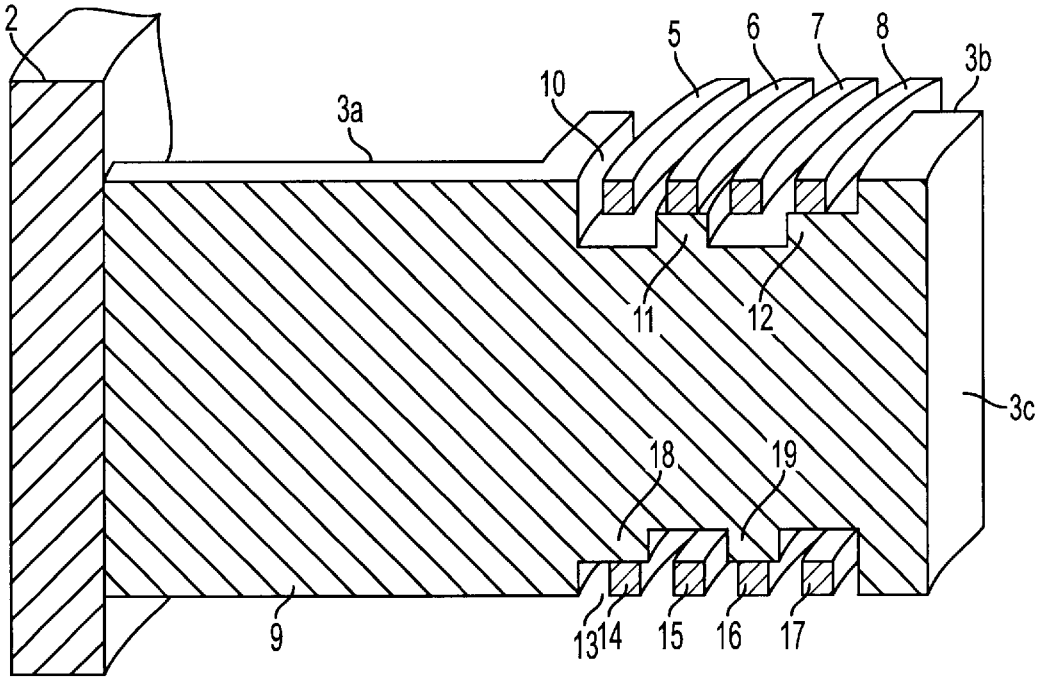
FIG. 2 schematically shows in section along the line II—II of FIG. 1 an anode vane of the anode structure of FIG. 1.

As can be more clearly seen in FIG. 2, the anode structure 1 includes four concentric anode straps 5, 6, 7 and 8 arranged coaxially within the cylindrical member 2. The straps 5 to 8 are of rectangular cross section in this embodiment but other configurations may be used if desired. The anode vane 9 shown in FIG. 2 includes a cut out portion 10 in the circumferential portion 3*b* within which the straps 5 to 8 are located. Upstanding ridges 11 and 12 are included within the cut out portion 10 and are arranged to be in electrical contact with two of the straps 6 and 8. The other two straps 5 and 7 are not in electrical contact with anode vane 9. The bottom edge of anode vane 9 as shown also includes a cut out section 13 within which are located four additional annular anode straps 14, 15, 16 and 17. Anode straps 14 and 16 are electrically connected to anode vane 9 via ridges 18 and 19 and the other anode straps 15 and 17 are not in electrical contact. Alternate anode vanes around the cylindrical member 2 are connected in the same way as that shown in FIG. 2 and the remaining anode vanes between them are connected oppositely.

Capacitance exists between facing surfaces of adjacent anode straps, being dependent on the extent of the facing area. In addition, capacitance also exists between the outermost face of the outer strap 5, say, and the facing part of anode vane 9 and similarly for the bottom outer strap 14 and the innermost faces of the two inner straps 8 and 17 which also face the anode vane 9. Capacitance also exists between the bottom face, for example, of anode strap 5 and the facing part of anode vane 9.

Because the anode straps 5 to 8 and 14 to 17 are mounted at the circumferentially extensive parts 3*b* of the anode vanes 3, the contribution to the capacitance which exists between them and facing parts of the anode varies themselves is increased compared to what would be the case in a conventional design in which each anode vane has only a radial component and is of limited width.

As shown in FIG. 1, some of the anode straps include gaps or discontinuities in their circumference for ease of fabrication, for example, strap 5, which is electrically connected to anode vane 20 adjacent anode vane 9, has a gap 21. The circumferential portion of anode vane 20 ensures that good electrical contact for obtaining mode separation is still achievable. However, the inclusion of a gap or gaps in an anode strap does reduce capacitance and hence it may be desirable in most cases to keep the anode straps as complete annular rings to maximize capacitance.

Figure 3:
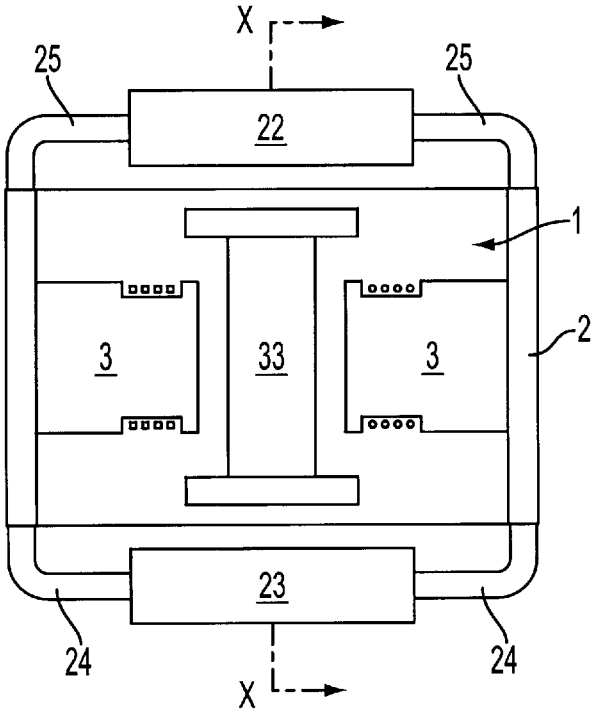
FIG. 3 schematically shows in longitudinal section a magnetron in accordance with the present invention.

With reference to FIG. 3, a magnetron incorporating the anode structure 1 illustrated in FIG. 1 and 2 also includes a cylindrical cathode 33 coaxially located within the anode structure 1 along longitudinal axis X-X through the magnetron. The magnetron includes permanent magnets 22 and 23 arranged to produce a magnetic field of relatively high strength in the gap between the cathode 33 and the anode structure 1. For example, where the magnetron is intended to operate at a frequency of 100 MHZ, the magnetic field provided is approximately 500 Gauss in an axial direction in the gap. Although in this embodiment permanent magnets are included to provide the magnetic field, other means may be used. For example, an electromagnet might be employed instead. The return path of the magnetic field is provided via straps 24, through the cylindrical member 2 and via straps 25. The cylindrical member 2 forms part of the microwave circuit. It also defines the vacuum envelope of the magnetron and fulfills a third function of providing a magnetic return path. The straps 24, 25 coupling the magnets to the cylindrical member 2 may be replaced by single components in other embodiments.

The anode structure shown in FIGS. 1 and 2 may of course be included in magnetrons having a conventional magnetic return path in which additional components are included and need not be used with a high magnetic field. However operating frequencies are then consequently higher.

The advantage of using the cylindrical member 2 as the magnetic return path is that it reduces the number of components required. Also, as steel is used, there is a weigh saving. If copper were to be used as in a conventional magnetron, it would need to be much thicker to withstand the stresses involved. This design also minimizes magnetic leakage to give good efficiency and increase cost effectiveness.

Figure 4:
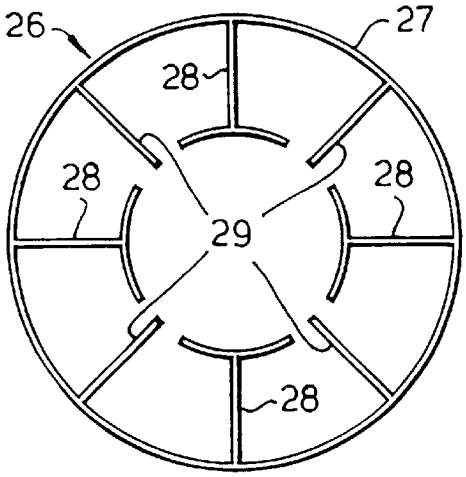
FIGS. 4 and 5 schematically illustrate respective different anode structures in accordance with the invention.

FIG. 4 schematically illustrates another anode structure 26 having a cylindrical member 27 which contains a plurality of T-shape anode vanes 28 alternately arranged around the cylindrical member 27 with a set of anode vanes 29, these having only a radially extensive portion and no circumferential portion.

Figure 5:
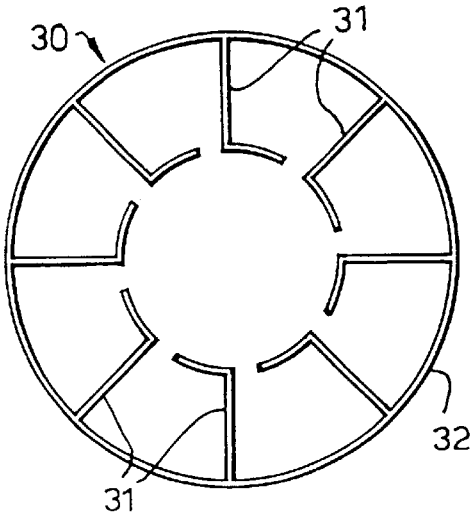

FIG. 5 schematically shows yet another structure 30 having L-shape vanes 31 located within a cylindrical member 32.

Both the anode structure of FIG. 4 and that of FIG. 5 may be incorporated in the magnetron of FIG. 3 in place of anode structure 1 or of course may be included in a conventional magnetron design in which a separate magnetic return path is included and a lower magnetic field is utilized.

As noted previously with reference to FIG. 1, each circumferentially extending portion 3*b* presents a cylindrical surface 3*c* facing inwardly toward the center of the cylindrical member 2 where the cathode region is located. In addition, the circumferentially extending portion 3*b* has end surfaces which are extensive in the radial direction. As can be seen in FIG. 1, respective gaps exists between adjacent radially extensive end surfaces of the circumferentially extending portions 3*b*. FIG. 1 shows that each circumferentially extending portion 3*b* has a length in the circumferential direction that is at least twice the length of the gap existing between a radially extending end surface of the circumferentially extending portion 3*b* and a free end of an adjacent anode vane (see also the embodiments of FIGS. 4 and 5 where the same relationship holds true). Moreover, FIG. 1 shows that the circumferentially extending portion 3*b* has a length that is greater than twice the thickness of the radially extensive portion 3*a* of the anode vane. As further seen in FIG. 1, the cylindrical surface 3*c* of each circumferentially extending portion 3*b* has a length in the circumferential direction that is greater than the thickness of the radially extensive portion 3*a* of the anode vane 3.

We claim:

1. An apparatus comprising an anode structure comprising: a cylindrical member; and a plurality of anode vanes disposed within said cylindrical member which define resonant cavities therebetween, each anode vane disposed within said cylindrical member having a substantially radially extensive first portion with an inner end and an outer end and a second portion at said inner end which is extensive in a substantially circumferential direction;

wherein said first portion of at least some of said plurality joins the respective second portion thereof at the midpoint along a circumferential length of said second portion;

wherein said plurality includes all anode vanes of said anode structure; and wherein said second portion has a face oriented toward the center of the cylindrical member that is greater than a wall thickness of said first portion.

2. The apparatus according to claim 1 further comprising a cathode located coaxially within said anode structure.

3. The apparatus as claimed in claim 1 wherein more than two anode straps are included at at least one end of said anode structure.

4. The apparatus as claimed in claim 3 wherein said anode straps are coupled to respective second portions of said first set of anode vanes.

5. A magnetron including: an anode structure; a cathode located coaxially within said anode structure; and said anode structure comprising: a cylindrical member; and anode vanes disposed within said cylindrical member which define resonant cavities therebetween, wherein each anode vane of a first set of said anode vanes has a substantially radially extensive first portion, with an inner end and outer end, and has a second portion at the inner end thereof which is extensive in a substantially circumferential direction; wherein each anode vane of a second set of said anode vanes has only a substantially radially extensive portion which is of a substantially uniform thickness; and anode vanes of said first set of said anode vanes being arranged alternately within said cylindrical member with anode vanes of said second set; and wherein said second portion has a face oriented toward the cathode that has a length in the circumferential direction that is greater than the wall thickness of said first portion.

6. An apparatus comprising an anode structure comprising: a cylindrical member; and anode vanes disposed within said cylindrical member which define resonant cavities therebetween, wherein each anode vane of a first set of said anode vanes has a substantially radially extensive first portion, with an inner end and an outer end, and has a second portion at the inner end thereof which is extensive in a substantially circumferential direction; wherein each anode vane of a second set of said anode vanes has a substantially radially extensive portion which is of a substantially uniform thickness; and anode vanes of said first set of said anode vanes being arranged alternately within said cylindrical member with anode vanes of said second set; wherein said second portion has a face oriented toward the center of the cylindrical member that is greater than a wall thickness of said first portion.

7. The apparatus as claimed in claim 6 wherein said first portion of at least some of said first set joins the respective second portion thereof at the midpoint along a circumferential length of said second portion.

8. The apparatus as claimed in claim 6 wherein said anode straps are coupled to respective second portions of said first set of anode vanes.

9. The apparatus according to claim 6, further comprising a cathode located coaxially within said anode structure.

* * * * *